United States Patent [19]

Rose

[11] 4,038,836

[45] Aug. 2, 1977

[54] PORTABLE, FOLDABLE EVAPORATIVE COOLER

[76] Inventor: Billy L. Rose, 4321 Appain Way, El Sobrante, Calif. 94803

[21] Appl. No.: 710,188

[22] Filed: July 30, 1976

[51] Int. Cl.[2] ..... F28D 5/00; F25D 3/08

[52] U.S. Cl. ..... 62/316; 62/457

[58] Field of Search ..... 62/315, 316, 457

[56] References Cited

U.S. PATENT DOCUMENTS

| | | | |
|---|---|---|---|
| 1,175,661 | 3/1916 | Purnelle | 62/316 |
| 3,279,208 | 10/1966 | Butler | 62/316 |
| 3,347,060 | 10/1967 | Barkan | 62/457 |
| 3,385,078 | 5/1968 | Teters | 62/316 |

*Primary Examiner*—Lloyd L. King

*Attorney, Agent, or Firm*—Berman, Aisenberg & Platt

[57] ABSTRACT

A foldable outdoor food cooler consisting of a flexible-walled container having rigid top and bottom walls. The container has a top reservoir compartment for receiving a quantity of water and has lower water-absorbing side walls below this top compartment made of burlap or the like, defining a food compartment, said food compartment being provided with spaced perforated rigid shelves. One of the lower walls includes a flap with Velcro strips on its inner margins cooperating with mating Velcro strips around the margins of an opening to provide access to the interior of the food compartment. The lower margins of the reservoir top compartment walls are stitched to the upper margins of the food compartment walls in a manner to provide controlled seepage of water from the top compartment to the food compartment walls, so as to replenish the water in the food compartment walls as evaporation thereof takes place, said evaporation providing the cooling action for the food compartment. The top and bottom walls are provided with opposing rigid flanged trays defining a compact body containing the intervening portions of the device when it is collapsed. The top tray member and wall have a removable closure cap and have suspension cables attached to a ring for suspending the device from a support. The flanged bottom tray also serves to catch excess water and to keep the bottom portion of the cooler device moist. The bottom pan is provided with a drain valve to control the amount of excess water retained in the bottom tray.

10 Claims, 11 Drawing Figures

FIG. 1.
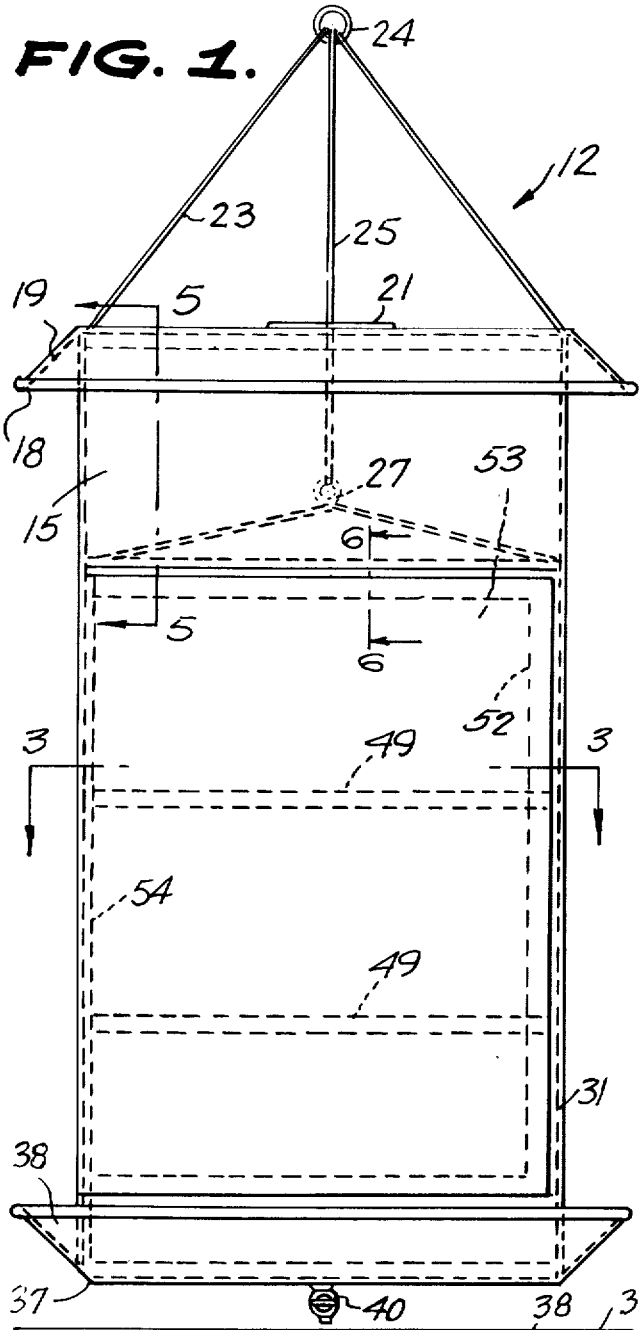
FIG. 2.
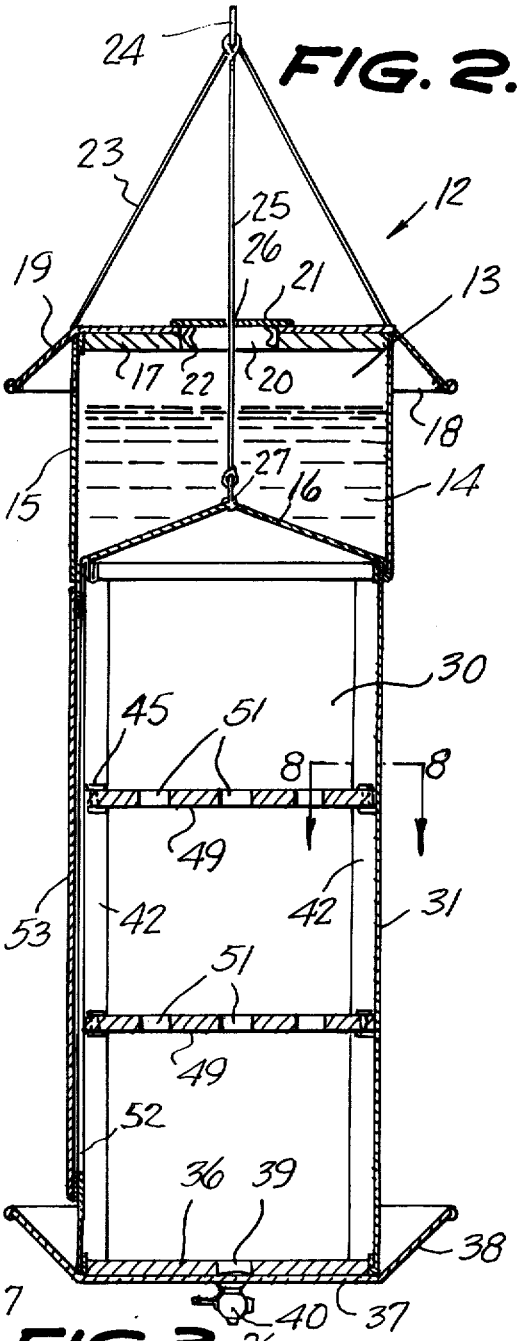
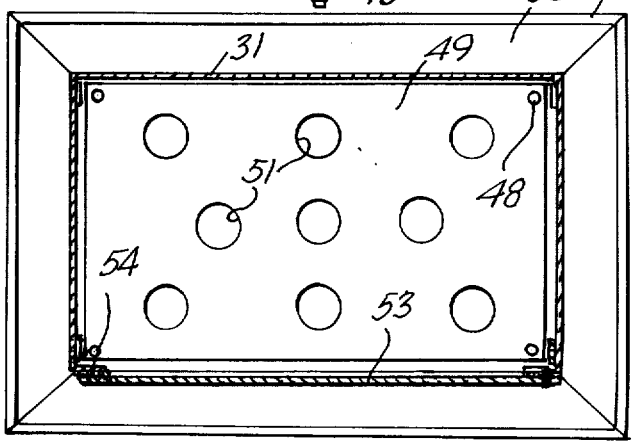
FIG. 3.
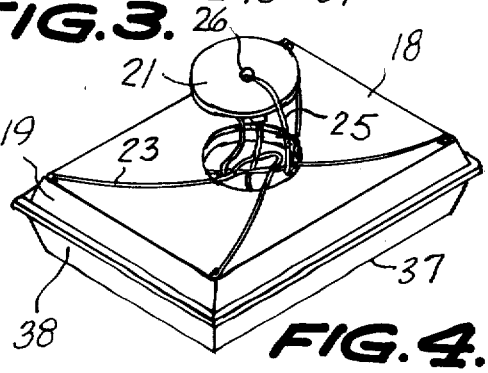
FIG. 4.

PORTABLE, FOLDABLE EVAPORATIVE COOLER

This invention relates to outdoor food cooling devices, and more particularly to a foldable outdoor food cooler which can be readily collapsed for transportation and storage when not in use.

A main object of the invention is to provide a novel and improved foldable outdoor food cooler which is simple in construction, which is easy to set up for use, and which provides a controlled cooling action.

A further object of the invention is to provide an improved foldable outdoor food cooler which is rugged in construction, which is inexpensive to manufacture, which can be folded to a relatively compact size so as to make it easy to transport or store the device, and which provides efficient cooling action based on the evaporation of water from the walls of its food-storing enclosure.

A still further object of the invention is to provide an improved foldable outdoor food cooler which can be suspended from any suitable support, such as from a tree branch or other similar support, which can be quickly expanded to an operating condition, which can be easily supplied with a quantity of water for furnishing the cooling action, and which includes highly improved seepage-control means for regulating the rate at which water is furnished to its evaporative surfaces, whereby the cooling water can be efficiently supplied and whereby the reservoir for such cooling water need be replenished only at relatively long intervals.

Further objects and advantages of the invention will become apparent from the following description and claims, and from the accompanying drawings, wherein:

FIG. 1 is an elevational view of an improved outdoor food cooler according to the present invention, shown set up for operation.

FIG. 2 is a transverse vertical cross-sectional view taken through the food cooler shown in FIG. 1.

FIG. 3 is a horizontal cross-sectional view taken substantially on the line 3—3 of FIG. 1.

FIG. 4 is a perspective view, to a reduced scale, showing the food cooler of FIGS. 1 to 3 in collapsed inoperative position, prepared for transportation or storage.

Figure 5:
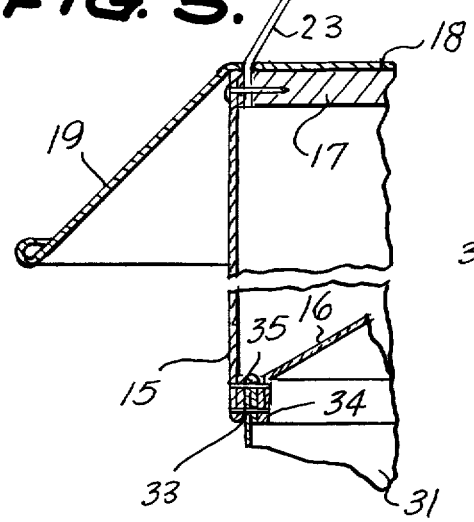
FIG. 5 is an enlarged fragmentary vertical cross-sectional view taken substantially on the line 5—5 of FIG. 1.

Referring to the drawings, 12 generally designates an improved outdoor food cooler constructed in accordance with the present invention. The food cooler 12 comprises a top reservoir compartment 13 made of substantially waterproof flexible material, such as canvas, or the like, adapted to receive a supply of water 14, the compartment 13 having the flexible peripheral wall 15 and the flexible bottom wall 16.

As above mentioned, the flexible peripheral wall 15 and the flexible bottom wall 16 may be made of suitable flexible material, such as closely-woven fabric, for example, canvas, or the like. The compartment 13 is provided with a top wall 17 of rigid material, such as plywood, or the like. The top margin of the peripheral flexible wall 15 is suitably secured to the peripheral edge of the rigid top wall 17. Overlying and secured to the top wall 17 is a downwardly facing rigid tray member 18 made of any suitable rigid material, such as sheet metal, plastic, or the like. As is clearly shown in FIGS. 1 and 2, the tray member 18 has the peripheral downwardly and outwardly inclined flange portion 19. The center portion of the top wall 17 and the tray member 18, secured thereto, is formed with a circular aperture 20 in which a removable closure plug 21 is lockingly engageable, the closure plug 21 being of substantially conventional construction and being formed with depending resilient locking lugs 22 which are frictionally engageable in the circular aperture 20. The closure member 21 is readily removable for admitting water into the reservoir chamber 13.

A plurality of flexible suspension cables 23 are secured at suitably spaced peripheral portions of the top wall assembly comprising the rigid wall element 17 and tray member 18. For example, in the generally rectangular structure illustrated in the drawings, the suspension cable elements 23 are secured to respective corner portions of the top wall structure. The cables 23 extend upwardly and are connected to a suspension ring 24. A central cable element 25, likewise secured to ring 24, extends downwardly through a central aperture 26 provided in the closure plug element 21 and is connected at its bottom end to the center portion of the flexible bottom wall 16, as shown at 27. The cable 25 is of a length such that it distends the central portion of bottom wall 16 upwardly in the manner illustrated in FIG. 2 when the device is hung from a suitable support, whereby to guide liquid outwardly and downwardly toward the junction of the bottom wall 16 with the peripheral wall 15, for a purpose presently to be described.

Figure 6:
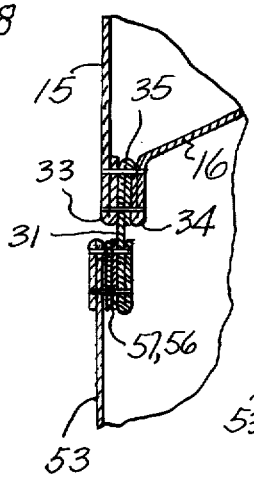
FIG. 6 is an enlarged fragmentary cross-sectonal view taken substantially on the line 6—6 of FIG. 1.
Figure 7:
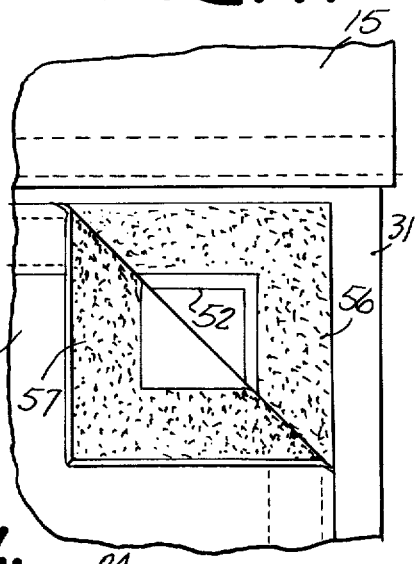
FIG. 7 is an enlarged fragmentary elevational view showing a corner portion of the access opening associated with the food compartment of the container of FIG. 1, with a corner portion of the closure flap of the food compartment folded downwardly and illustrating the cooperating Velcro strips employed for releasably securing the closure flap in covering relationship to the access opening.

Designated at 30 is a food compartment comprising a flexible peripheral wall 31 of suitable porous, water-absorbent material, such as loosely woven burlap, or the like, the top edge of the peripheral depending flexible wall 31 being fastened between the bottom marginal portion of the water reservoir peripheral wall 15 and the outer marginal portion of the bottom wall 16 of water reservoir in a manner to permit a controlled rate of seepage of water 14 from the reservoir 13 to the depending peripheral wall 31 of food compartment 30. Thus, as shown in FIGS. 5 and 6, the bottom edge portion of the reservoir peripheral wall 15 is formed with a hem fold 33 and the outer rim potion of the water reservoir bottom wall 16 is formed with a similar opposing hem portion 34. The top edge portion of the food compartment peripheral wall 31 is formed with a folded hem portion 35 which is received between the hem portions 33 and 34 and which is stitched therebetween to provide a mechanically secure connection which has a sufficiently wide stitch spacing to provide the desired controlled degree of seepage from the reservoir 13 to the depending water-absorbent food compartment peripheral wall 31.

Food compartment 30 is provided with a rigid bottom wall 36 of suitable rigid material, such as plywood, or the like, similar to the top wall 17 of the water compartment 13. The bottom edge portions of the depending peripheral wall 31 are suitably secured to the outer edges of the rigid bottom member 36, and an upwardly facing tray member 37, substantially identical to the top tray member 18, is secured to the bottom surface of bottom wall 36. Bottom tray member 37 is provided with the upwardly and outwardly inclined peripheral flange 38 which is substantially identical to the flange 19 of the top tray member 18. Bottom wall 36 and tray member 37 are formed with a central aperture 39, and the tray member 37 is provided with a drain valve 40 communicating with the aperture 39.

Figure 8:
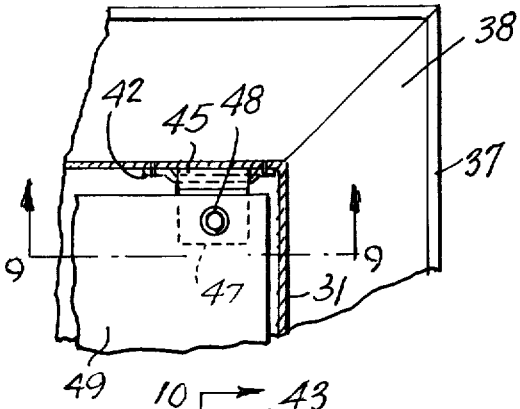
FIG. 8 is an enlarged fragmentary horizontal cross-sectional view taken substantially on the line 8—8 of FIG. 2.
Figure 9:
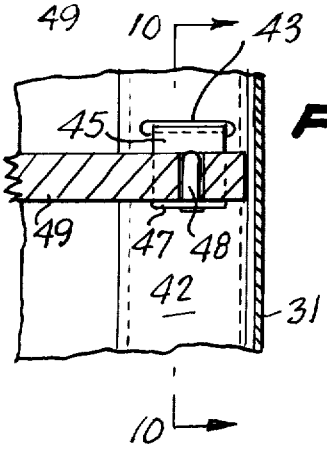
FIG. 9 is a fragmentary vertical cross-sectional view taken substantially on the line 9—9 of FIG. 8.
Figure 10:
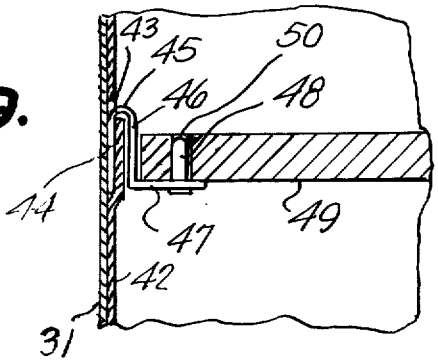
FIG. 10 is a cross-sectional view taken substantially on the line 10—10 of FIG. 9.

The food cooler compartment peripheral wall 31 is provided at its inner corner portions with vertical reinforcing strips 42, as shown in FIG. 2, suitably stitched to said corner portions in the manner illustrated in FIGS. 8 and 9, and formed with spaced horizontal slots 43 at corresponding intermediate levels in the food compartment 30, receiving the downwardly extending leg portions 44 of inverted U-shaped brackets 45, as shown in FIG. 10. The opposite legs 46 of the brackets 45 are formed with inwardly extending horizontal arms 47 on which are rigidly secured upstanding rigid pins 48. Respective shelves 49 of suitable rigid material, such as plywood or the like, are provided, shaped to fit inside the compartment 30 in horizontal positions, are formed at their corner portions with apertures 50 located to receive the upstanding pins 48, to thereby hold the shelves 49 in bearing engagement with the arms 47 of the corner brackets 45. Thus, in the specific embodiment illustrated in the drawings, two shelves 49 are provided, with corresponding sets of brackets 45 supported on the corner strips 42 in the manner above described. The shelves 49 are of generally rectangular shape to fit within the rectangular enclosure 30, and are preferably provided with ventilation apertures 51 distributed thereover.

One of the major faces of the enclosure 30 is formed with a large rectangular door opening 52, and stitched to one side margin of said door opening is a correspondingly shaped flexible door flap member 53 formed of the same water-absorbent flexible material as the depending peripheral wall 31 of the food compartment. Thus, the closure flap 53 may be made of burlap similar to the burlap material employed for the peripheral wall 31. Secured around the marginal portion of the opening 52 at all portions thereof except at the stitched portion 54 where the closure flap 53 is connected, are strips of Velcro tape 56 facing outwardly, and secured to corresponding marginal portions of the flexible flap member 53 are similar inwardly facing strips 57 of Velcro tape, lockingly interengageable with the Velcro strips 56 to hold the flap 53 in closed covering position over the door opening 52. As is well known, the tape strips 56 and 57 are of a type which lock together under manual pressure and which can be manually disengaged by pulling the pieces carrying the tape segments apart, it being merely necessary to exert sufficient manual force to disengage the pieces. Thus, the flap 53 may be readily opened by merely pulling it away from the aperture to thereby provide access to the interior of the food compartment 30, and similarly may be readily closed by merely pressing the marginal strip portions 57 against the mating marginal strip portions 56 provided around the opening 52.

In operation, with a quantity of water contained in the reservoir 13, and with the device suspended from a suitable support, for example, from the branch of a tree, employing a suitable cord or rope to connect the branch to the suspension ring 24, the water 14 in the reservoir 13 will seep downwardly through the stitching at the hem portions 33, 34 and 35, and will permeate into the water-absorbent food compartment wall 31, saturating the wall 31 with moisture, which by evaporation, provides a cooling action for the interior of the food compartment. Excess water may accumulate in the lower tray 38, and can be drained off by opening the drain valve 40. However, the rate of seepage is such as to maintain the wall 31 saturated with water under normally warm weather conditions, and to thus provide for evaporation sufficient to maintain the contents of the food compartment 30 in a relatively cool condition and to prevent spoilage thereof. As above mentioned, the water 14 in the reservoir 13 may be readily replenished through the top closure opening 20.

Figure 11:
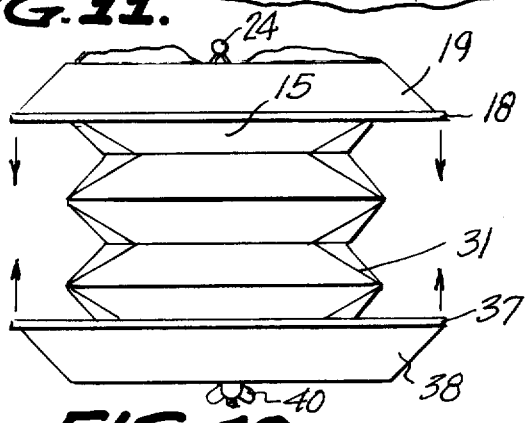
FIG. 11 is an elevational view illustrating the manner in which the food cooler is collapsed to reduce its bulk and to fold to the condition shown in FIG. 4 so that it may be arranged for transportation or storage.

When the device is not in use and is to be collapsed for transportation or storage, the tray members 18 and 37 are brought together in the manner illustrated in FIG. 11, resulting in a final completely collapsed package such as that shown in FIG. 4 wherein all of the parts are contained between the meeting tray members 18 and 37. As will be apparent from FIG. 3, the resultant package is very compact and can be easily stored or transported.

It will be noted that the shelves 49 serve not only for supporting food articles in the cooling enclosure 30, but also act as anti-spreading means to prevent the flexible enclosure peripheral wall 31 from bulging outwardly or from being otherwise distorted. Thus, it will be seen that the pins 48 engage in the openings 50 of the shelves and thus provide connections of the corner portions of the shelves to the corner protions of the food enclosure which serve to maintain the normal shape of the food enclosure and to prevent it from being excessively distorted either inwardly or outwardly under normal conditions of use, namely, when it is suspended from a suitable support in its operative condition, namely, in the condition illustrated in FIGS. 1 and 2. However, when the food cooler device is to be collapsed for transportation or storage, the flexibility of the peripheral side walls thereof permits them to extend outwardly except at the connection points to the shelves 49 and to the top and bottom wall elements 17 and 36, as shown in FIG. 11.

While a specific embodiment of an improved outdoor food cooler has been disclosed in the foregoing description, it will be understood that various modifications within the spirit of the invention may occur to those skilled in the art. Therefore, it is intended that no limitations be placed on the invention except as defined by the scope of the appended claims.

What is claimed is:

1. An outdoor food cooler comprising a water compartment made of substantially waterproof material, suspension means connected to said water compartment, said water compartment having a rigid top wall, a flexible bottom wall and a flexible peripheral wall, an enclosure comprising peripherally extending depending wall and means to fasten it between said flexible peripheral wall and the periphery of said bottom wall, the fastening means being sufficiently permeable to allow seepage of water from the water compartment to said depending wall means, said depending wall means being of a relatively porous water-absorbent material, a rigid bottom wall peripherally secured to the bottom edge of said depending wall means, whereby to define a food storage space thereabove, said depending wall means having an opening providing access to said storage space, flexible closure means on said depending wall means shaped to overlie said opening, and means to detachably secure said closure means in overlying relationship to said opening.

2. The outdoor food cooler of claim 1, and opposing rigid tray members secured to said rigid top wall and rigid bottom wall, said flexible peripheral wall and depending wall means being sufficiently flexible to be collapsed at times so as to be received between the tray members when the peripheral edges of the tray members are both adjacent to each other.

3. The outdoor food cooler of claim 1, and at least one rigid shelf member in said food storage space, and means on the interior of the depending wall means supportingly engaging said rigid shelf member.

4. The outdoor food cooler of claim 3, and wherein the permeable fastening means comprises stitching.

5. The outdoor food cooler of claim 4, and wherein said water compartment peripheral wall comprises relatively closely woven fabric material.

6. The outdoor food cooler of claim 5, and wherein said depending wall means comprises relatively loosely woven fabric material.

7. The outdoor food cooler of claim 6, and wherein said water compartment comprises canvas and said depending wall means comprises burlap.

8. The outdoor food cooler of claim 1, and a plurality of spaced rigid bracket elements secured on the inside of said depending wall means at a common level, and a rigid shelf member supportingly engaged on said rigid bracket elements.

9. The outdoor food cooler of claim 8, and wherein said rigid bracket elements include upstanding rigid pins and said shelf member is formed with apertures receiving said pins and thereby preventing outward spreading of the depending wall means at the region of said shelf member.

10. The outdoor food cooler of claim 9, and wherein said opening is provided at its margin with an outwardly facing Velcro strip, and wherein said flexible closure means comprises a flap of flexible material provided at its inner marginal portion with an inwardly facing Velcro strip lockingly engageable with the first-named Velcro strip.

* * * * *